US007458834B1

(12) United States Patent
Chen et al.

(10) Patent No.: US 7,458,834 B1
(45) Date of Patent: Dec. 2, 2008

(54) MINIATURE COAXIAL CONNECTER WITH MICRO-SWITCH

(75) Inventors: Sung-Wen Chen, Hsin-Tien (TW); Tung-Liang Huang, Hsin-Tien (TW)

(73) Assignee: Insert Enterprise Co., Ltd., Hsin-Tien (TW)

( * ) Notice: Subject to any disclaimer, the term of this patent is extended or adjusted under 35 U.S.C. 154(b) by 0 days.

(21) Appl. No.: 11/898,480

(22) Filed: Sep. 12, 2007

(30) Foreign Application Priority Data

May 22, 2007 (TW) ..... 96208300 U

(51) Int. Cl.
*H01R 13/73* (2006.01)

(52) U.S. Cl. ..... 439/188

(58) Field of Classification Search ..... 439/188, 439/63, 944, 581
See application file for complete search history.

(56) References Cited

U.S. PATENT DOCUMENTS 5,108,300 A * 4/1992 Weber ..... 439/188
5,320,546 A * 6/1994 Weber ..... 439/188
5,803,757 A * 9/1998 Wang ..... 439/188
6,390,840 B1 * 5/2002 Wang ..... 439/188

* cited by examiner

*Primary Examiner*—Tho D Ta

(57) ABSTRACT

A miniature coaxial connecter with a micro-switch comprises a signal terminal and a grounding element; the signal terminal is provided with an elastic portion and a first combination portion; the elastic portion is provided with a long slot used for adjusting elasticity thereof; the grounding element is provided with a contact portion and a second combination portion; a front section of the contact portion is provided with tabs bended toward the elastic portion; the elastic portion is wider and the connection length of it and the first combination portion is longer to allow it rather not to be deformed by an external force. Besides, the wider grounding element is provided with the tabs. Whereby, the connecter is manufactured more easily and the manufacturing yield can be elevated.

17 Claims, 6 Drawing Sheets

MINIATURE COAXIAL CONNECTER WITH MICRO-SWITCH

BACKGROUND OF THE INVENTION

1. Field of the Invention

The present invention relates to n electric connecter, and more particularly to a miniature coaxial connecter with a micro-switch.

2. Description of Related Art

There are many electric connecters with a switch, such as those disclosed in Taiwan Patent NOS. I260115, I250701 and I232011 and U.S. Pat. Nos. 5,989,046, 6,390,840, 6,659,789, 6,761,571, 6,932,615 and 7,080,997.

Please refer to FIGS. 1 and 2. A conventional miniature coaxial connecter 10 with a micro-switch is constituted by a metal housing 11, an insulator 12, a signal terminal 13 and a grounding element 14.

The front and the rear ends of the metal housing 11 are respectively provided with a first cylinder body 111 and a fixing portion 112; a buckling hole 113 is disposed on each side of the first portion 112; an accepting groove 114 is further disposed on the first fixing portion 112.

The front and the rear ends of the insulator 12 are respectively provided with a second cylinder body 121 and a second fixing portion 122; a tenon 123 gradually expanded outward from the front end thereof toward the rear end thereof is disposed on each side of the second fixing portion 122; the second fixing portion 122 is further provided with first and second insertion grooves 124 and 125 extended up to the rear end thereof. Furthermore, first and second extension portions 126 and 127 are respectively disposed at the rear ends of the two sides of the second fixing portion 122 and the lower ends thereof are respectively higher than the rear ends of the two sides of the second fixing portion 122.

The front and the rear ends of a signal terminal 13 are respectively provided with an elastic portion 131 and a first combination portion 132; the elastic portion 131 is provided with a tab 133 extended outward from a first side thereof; the front and the rear ends of the first combination portion 132 are respectively provided with a front notch 134 and a rear notch 135; the lower end of the rear end of the first combination portion 132 is provided with a first sheet 136 extended outward from a second side thereof. A tenon 137 is disposed on the upper end of the first combination portion 132.

The front and the rear ends of the grounding element 14 are respectively provided with a contact portion 141 and a second combination portion 142; a rear notch 143 is disposed on the rear end of the second combination portion 142; the lower end of the rear end of the second combination portion 142 is provided with a second sheet 144 extended outward from a first side thereof. A tenon 145 is disposed on the upper end of the second combination portion 142.

The elastic portion 131 and the front section of the first combination portion 132 of the signal terminal 13 are respectively accepted in the second cylinder body 121 and the first insertion groove 124 of the insulator 12; the first sheet 136 is propped against the lower side of the first extension portion 126. The tenon 137 is buckled in the first insertion groove 124. The contact portion 141 and the front section of the second combination portion 142 of the grounding element 14 are respectively accepted in the second cylinder portion 121 and the second insertion groove 125; the second sheet 144 is propped against the lower side of the second extension portion 127. The tenon 145 is buckled in the second insertion groove 125. The second cylinder body 121 and the front section of the second fixing portion 122 of the insulator 12 are respectively accepted in the first cylinder body 111 and the first fixing portion 112 of the metal housing 11; the tenon 123 is engaged with the buckling hole 113.

The elastic portion 131 and the contact portion 141 are respectively positioned in the second cylinder body 121, and the front end of the elastic portion 131 is inclined away from the direction of the contact portion 141, the tab 133 is brought into contact with the contact portion 141 to from an electric combination state. A male terminal will drive the front end of the elastic portion 131 away from the contact portion 141 when the male terminal is inserted into the second cylinder body 121 to cause the tab 133 not to contact with the contact portion 141.

The elastic portion 131 of the signal terminal 13 mentioned above is rather long and thin such that it can meet the requirement of elasticity. As the lower end of the joinder of the elastic portion 131 and the first combination portion 132 is provided with the front notch 134, the connection length of the elastic portion 131 and the first combination portion 132 is shorter, the combination structure is apt to be deformed by an external force to cause the tab 133 not to contact with the contact portion 141 to lose the switch function. Besides, because the tab 133 is connected to the longer and thinner elastic portion 131, it is not easy to be bended while manufacturing, and because it is inclined an angle with the elastic portion 131 if a slight error happens, the tab 133 can comparatively not contact with the contact portion 141 stably such that a defective is caused.

SUMMARY OF THE INVENTION

For improving the structure of a miniature coaxial connecter with a micro-switch to allow the manufacturing thereof is more convenient and the manufacturing defective fraction to be decreased, the present invention is proposed.

The main object of the present invention is to provide a miniature coaxial connecter with a micro-switch, allowing an elastic portion of a signal terminal to be wider, the connection length of the elastic portion and a combination portion to be longer and the structure thereof not to be deformed while subjecting to an external force so as to elevate the manufacturing yield.

An other object of the present invention is to provide a miniature coaxial connecter with a micro-switch, allowing a wider grounding element to be provided with a tab so as to be manufactured more easily, and a tab to be mounted on unmoved grounding element to touch a movable signal terminal more easily so as to elevate the manufacturing yield.

Still another object of the present invention is to provide a miniature coaxial connecter with a micro-switch, allowing a metal housing to be provided with a rear cover so as to elevate the signal transmission quality.

BRIEF DESCRIPTION OF THE DRAWINGS

The present invention can be more fully understood by reference to the following description and accompanying drawings, in which.

DETAILED DESCRIPTION OF THE PREFERRED EMBODIMENTS

Figure 2:
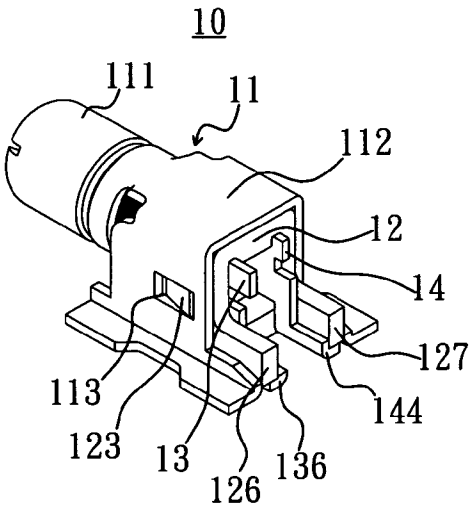
FIG.2 (PRIOR ART)
FIG. 2 is a perspective view of a conventional connecter.
Figure 1:
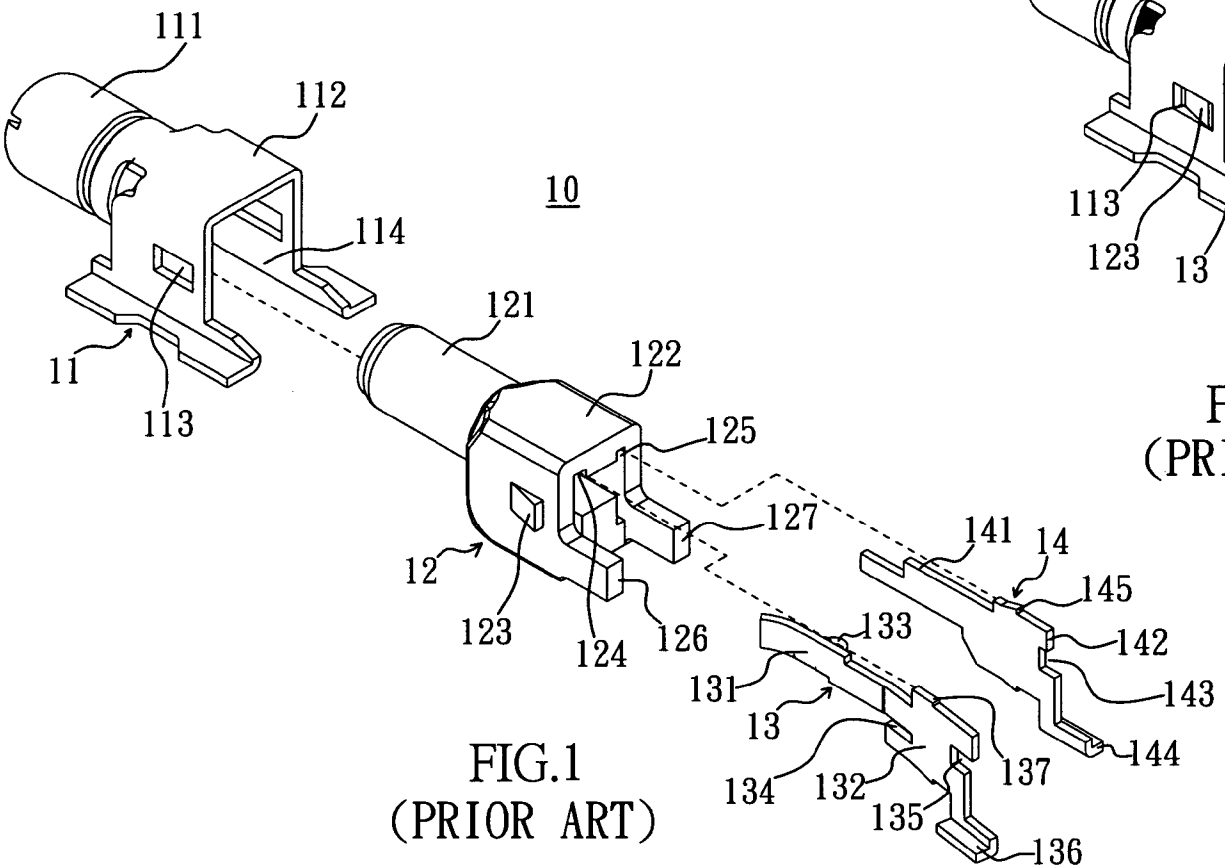
FIG.1 (PRIOR ART)
FIG. 1 is an exploded view of a conventional connecter.
Figure 4:
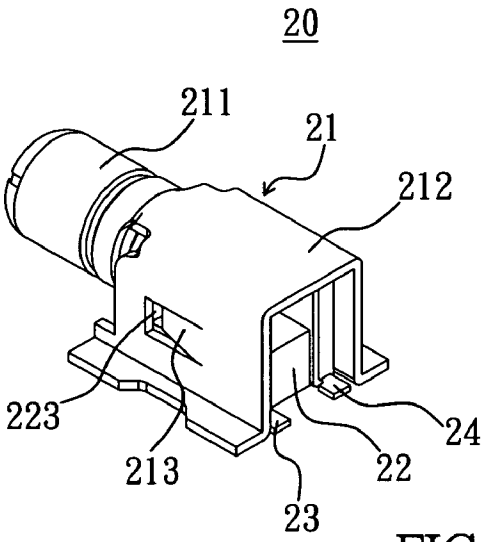
FIG. 4 is a perspective view, showing a connecter of the first preferred embodiment according to the present invention.
Figure 3:
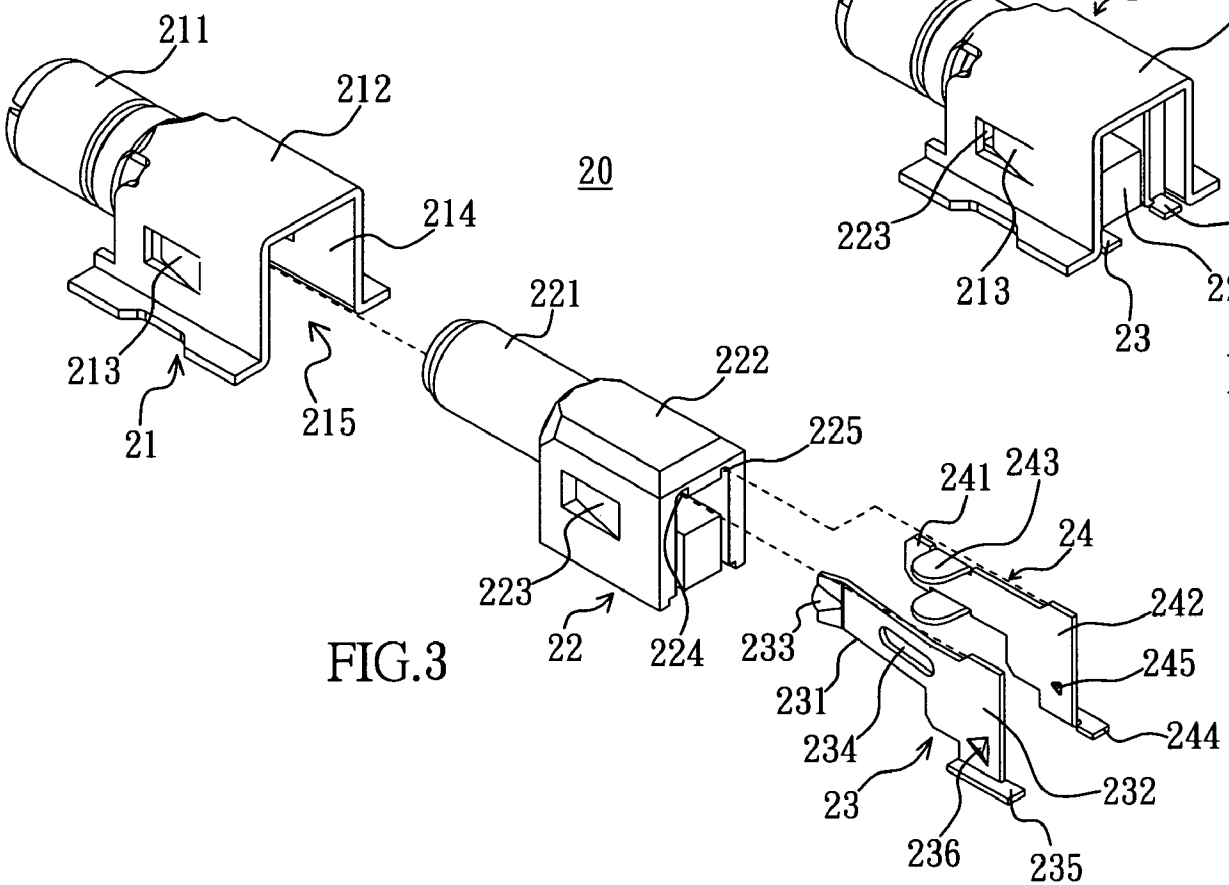
FIG. 3 is an exploded view, showing a connecter of a first preferred embodiment according to the present invention.
Figure 5A:
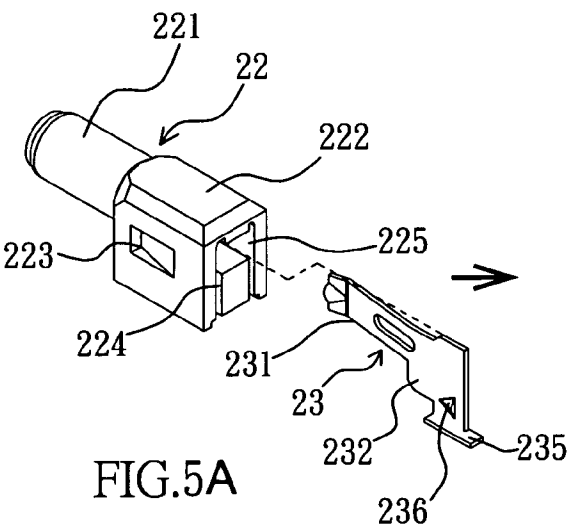
FIGS. 5A, 5B, 5C and 5D are schematic views, respectively showing steps of an assembly process of a connecter of the first preferred embodiment according to the present invention.
Figure 5B:
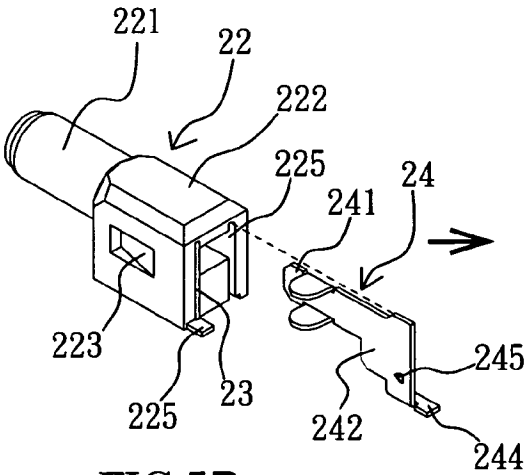
Figure 5C:
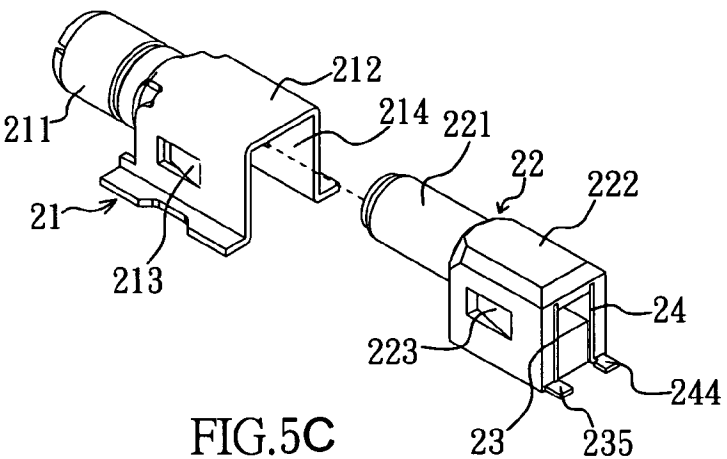
Figure 5D:
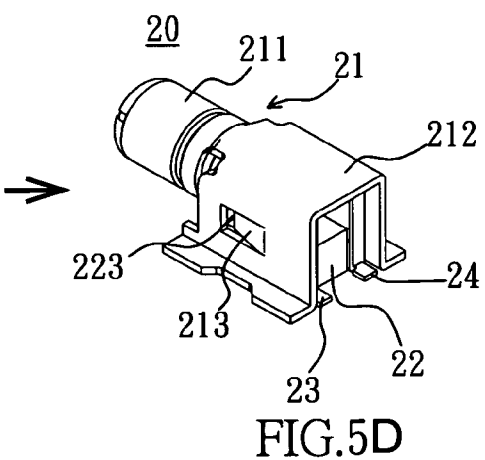

Please refer to FIGS. 3 and 4. A miniature coaxial connecter with a micro-switch according to the present invention is used for allowing the manufacturing of the connecter to be more convenient. A connecter 20 of a first preferred embodiment according to the present invention comprises a metal housing 21, an insulator 22, a signal terminal 23 and a grounding element 24.

The front and the rear ends of the metal housing 21 are respectively provided with a cylinder body 211 and a first fixing portion 212; a first buckling portion 213 such as a buckling tab is disposed on each side of the first fixing portion 212 and an accepting groove 214 is further disposed on the first fixing portion 212; the rear end of the accepting groove 214 is provided with an opening 215.

The front and the rear ends of the insulator 22 are respectively provided with a second cylinder body 221 and a second fixing portion 222; a second buckling portion 223 such as a buckling hole corresponding to the buckling tab is disposed on each side of the second fixing portion 222 and the second fixing portion 222 is further provided with first and second insertion grooves 224 and 225 extended up to the rear end thereof.

The front and the rear ends of the signal terminal 23 are respectively provided with an elastic portion 231 and a first combination portion 232, in which the elastic portion 231 is deflected outward from a first side of the signal terminal 23 and a bended section 233 disposed at the front end thereof is bended outward from a second side thereof; the elastic portion 231 also has a long slot 234 disposed thereon; the lower end of the rear end of the first combination portion 232 is provided with a first sheet 235 extended outward from a second side thereof. Furthermore, a buckling tenon 236 is disposed on the second side of the first portion 232.

The front and the rear ends of the grounding element 24 are respectively provided with a contact portion 241 and a second combination portion 242, in which a front section of the contact portion 241 is provided with tabs 243 bended outward from a second side thereof and the lower end of the rear end of the second combination portion 242 is provided with a second sheet 244 extended outward from a first side thereof. Furthermore, a buckling tenon 245 is provided on the first side of the second combination portion 242.

Please refer to FIGS. 5A to 5D. When the connecter 20 of the present invention is assembled, the elastic portion 231 and the first combination portion 232 of the signal terminal 23 are respectively allowed to accept in the second cylinder body 221 and the first insertion groove 224. The first sheet 235 is propped against the lower side of the inner side of the insulator 22 and extended out of the rear end thereof. The buckling tenon 236 is buckled in the first insertion groove 224. And then, the contact portion 241 and the second combination portion 242 of the grounding element 24 are respectively allowed to accept in the second cylinder body 221 and the second insertion groove 225 of the insulator 22. The second sheet 244 is propped against the lower side of the inner side of the insulator 22 and extended out of the rear end thereof and the buckling tenon 245 is buckled in the second insertion groove 225. Furthermore, the second cylinder body 221 and the second fixing portion 222 of the insulator 22 are respectively accept in the first cylinder body 211 of the metal housing 21 and the accepting groove 214 of the first fixing portion 212. The first and the second buckling portions 213 and 223 are engaged with each other, and the assembly of the connecter 20 is finally completed.

Figure 6:
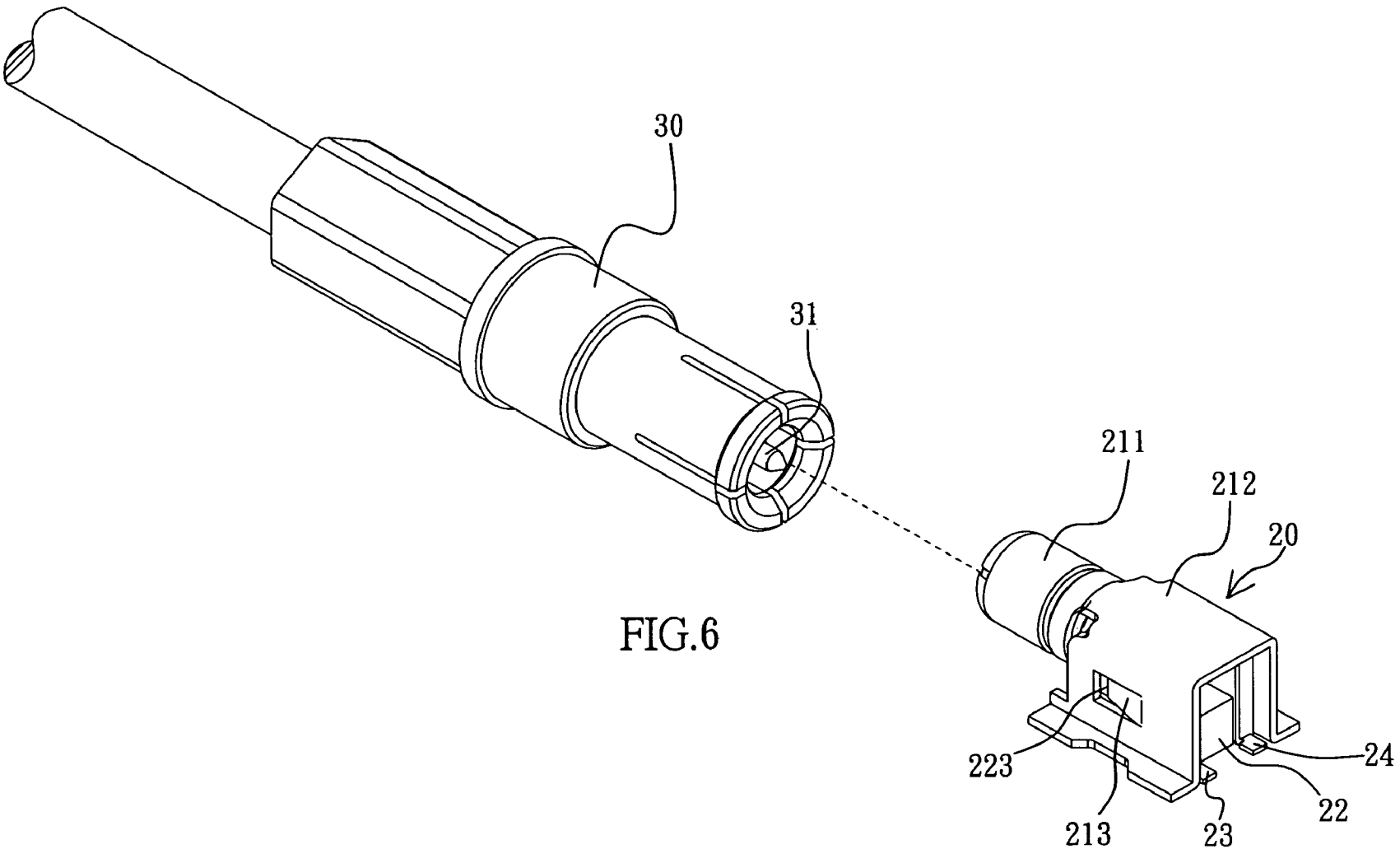
FIG. 6 is a schematic view, showing a connecter of the first preferred embodiment according to the present invention and another connecter before coupling.
Figure 7:
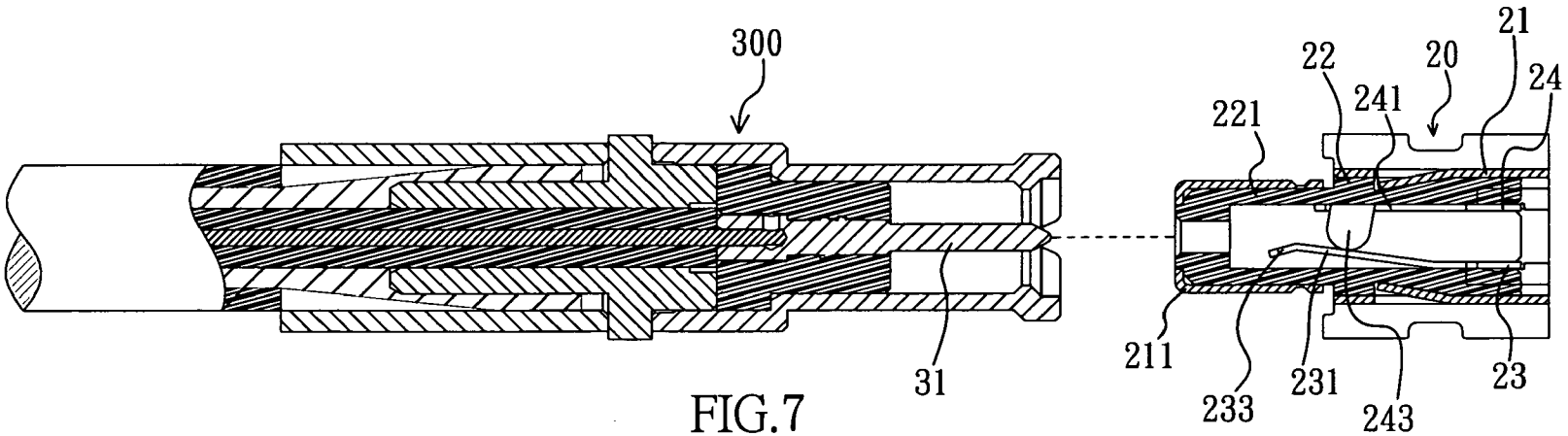
FIG. 7 is a cross sectional view, showing a connecter of the first preferred embodiment according to the present invention and another connecter before coupling.
Figure 8:
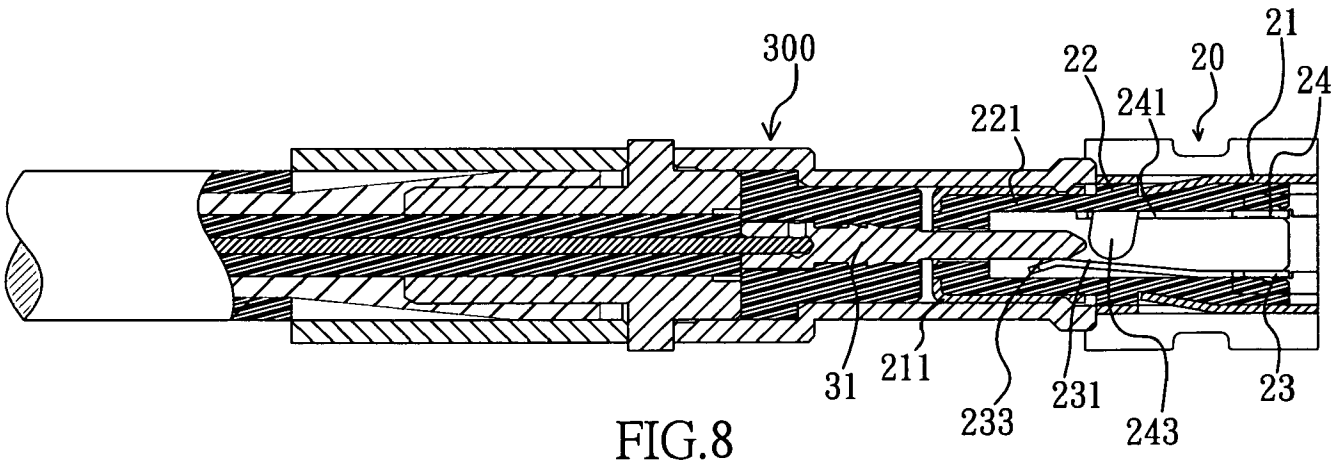
FIG. 8 is a cross sectional view, showing a connecter of the first preferred embodiment according to the present invention and another connecter after coupling.

Please refer to FIGS. 6, 7 and 8. FIGS. 6 and 7 show that a male terminal 31 of a connecter 30 is not inserted in the connecter 20 yet. Because the elastic portion 231 of the signal terminal 23 is deflected outward from the first side thereof, i.e. inclined toward the contact portion 241, this enable the elastic portion 231 to be elastically brought into contact with the tabs 243 as FIG. 7 shows. When the male terminal 31 is inserted into the second cylinder body 221 to contact with the elastic portion 231 and in the meantime, drive the elastic 231 to separate from the tabs 243, the tabs 243 will then not contact with elastic portion 231; the bended section 233 at the front end of the elastic portion 231 has the function of guiding the mail terminal 31 to contact with the elastic portion 231 as FIG. 8 shows.

Please refer to FIG. 3 again. The design that the long slot 234 disposed on the elastic portion 231 of the signal terminal 23 is used to adjust the elasticity thereof allows the elastic portion 231 to be wider to have a longer connection length to connect with the first combination 232; it is rather not be deformed when an external is exerted and keeps contacting with the tabs 243. Besides, because the tabs 243 are disposed on the wider contact portion 241 of the grounding element 24, it is easy to bend the tab 243 while manufacturing and because the tab 243 is fixed on the unmoved grounding element 24, it can contact with the elastic portion 231 more stably even if the bended angle of the tab 243 is slightly missed. Therefore, a defective is not caused.

Figure 10:
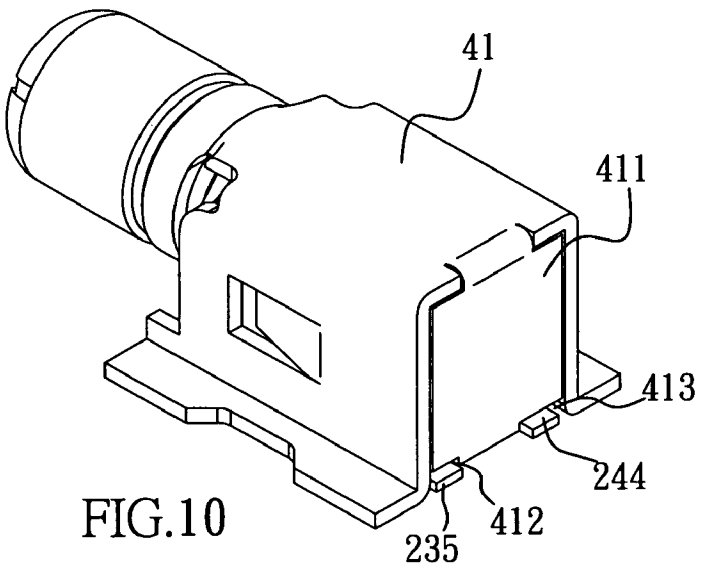
FIG. 10 is a perspective view, showing a connecter of a second preferred embodiment according to the present invention.
Figure 9:
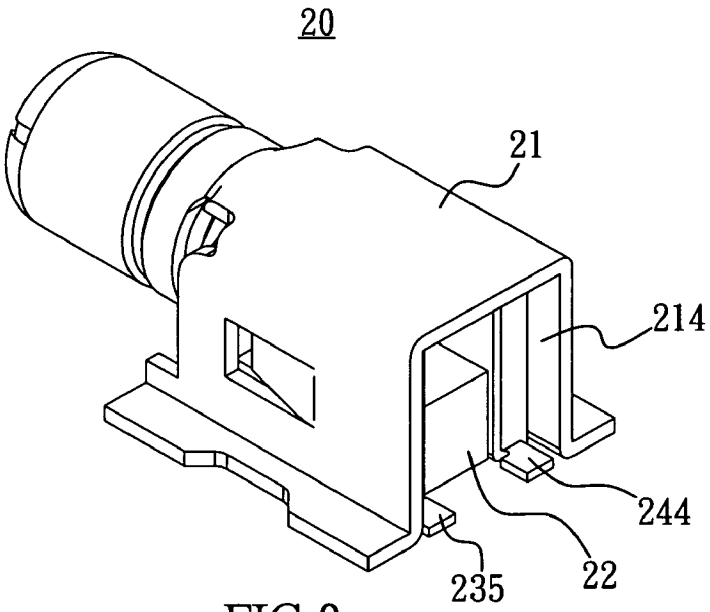
FIG. 9 is a perspective view, showing a connecter of the first preferred embodiment according to the present invention.

Please refer to FIGS. 3, 9 and 10. A connecter 40 of a second preferred embodiment according to the present invention is provided with almost the same structures and the functions as the connecter 20 shown in FIGS. 3 and 9, except the rear end of a metal housing 41 is connected to a rear cover 411 used for shielding an opening of the rear end of an accepting groove of the metal housing 41. The rear cover 411 is provided with notches 412 and 413 respectively accepting the first and the second sheets 235 and 244 to allow the rear cover 411 not to contact with the first and the second sheets 235 and 244. A large part of structures of the signal terminal 23 and the grounding element 24 are allowed to cover in the accepting groove by the metal housing 41 except the rear ends of the first and the second sheets 235 and 244 through the rear cover 411 to prevent them from being interfered by other electromagnetic waves outside the metal housing 41 to elevate the signal transmission quality of the signal terminal 23.

The miniature coaxial connecter with a micro-switch of the present invention allows the elastic portion of the signal terminal to be wider and the connection length of the elastic portion and the first combination portion to be longer; it allows the elastic portion not to be deformed by an external force so as to elevate the manufacturing yield. Furthermore, the wider grounding element is allowed to provide with the tabs, this made the manufacturing to be easier, and the tabs disposed on the unmoved grounding element can touch the movable signal terminal more easily so that the manufacturing yield can be elevated. Furthermore, the metal housing is allowed to provide with the rear cover; it can elevate the signal transmission quality.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A miniature coaxial connecter with a micro-switch, comprising:

a metal housing, front and rear ends thereof being respectively provided with a first cylinder body and a first fixing portion; said first fixing portion being provided with an accepting groove; a rear end of said accepting groove being provided with an opening;

an insulator, front and rear ends thereof being respectively provided with a second cylinder body and a second fixing portion; said second fixing portion being provided with first and second insertion grooves extended up to a rear end thereof; said second cylinder body and said second fixing portion being respectively accepted in said first cylinder body and said accepting groove;

a signal terminal, front and rear ends thereof being respectively provided with an elastic portion and a first combination portion; said elastic portion and said first combination portion being respectively accepted in said second cylinder body and said first insertion groove; and a grounding element, front and rear ends thereof being respectively provided with a contact portion and a second combination portion; said contact portion and said second combination portion being respectively accepted in said second cylinder body and said second insertion groove; wherein, said elastic portion is provided with a long slot and thereby used for adjusting the electricity thereof to allow said elastic portion to be wider; a front section of said contact portion is provided with tabs bended toward said elastic portion; said elastic portion is inclined toward said contact portion to contact with said tabs elastically; whereby, when a male terminal is inserted into said second cylinder body to bring into contact with said elastic portion and in the meantime, drive said elastic portion to separate from said tabs to cause the tabs not to contact with said elastic portion.

2. The connecter according to claim 1, wherein a lower end of a rear end of said first combination is provided with a first sheet propped against a lower side of an inner side of said insulator.

3. The connecter according to claim 2, wherein a lower end of a rear end of said second combination portion is provided with a second sheet propped against a lower side of an inner side of said insulator.

4. The connecter according to claim 3, wherein corresponding first and second coupling portions engaged with each other are respectively disposed on sides of said first and said second fixing portions.

5. The connecter according to claim 4, wherein said first combination portion is provided with a buckling tenon buckled in said first insertion groove.

6. The connecter according to claim 5, wherein said second combination is provided with a buckling tenon buckled in said second insertion groove.

7. The connecter according to claim 6, wherein said first and said second buckling portions respectively are corresponding buckling tab and buckling hole.

8. The connecter according to claim 7, wherein said first and said second sheets are respectively extended out of a rear end of said insulator.

9. The connecter according to claim 8, wherein a rear end of said metal housing is connected with a rear cover used for shielding an opening of a rear end of said accepting groove.

10. The connecter according to claim 8, wherein a rear end of said metal housing is connected with a rear cover; said rear cover shields an opening of a rear end of said accepting groove and is provided with two notches used for respectively accepting said first and said second sheets extended out of a rear end of said insulator.

11. The connecter according to claim 1, wherein a rear end of said metal housing is connected with a rear cover used for shielding an opening of a rear end of said accepting groove.

12. The connecter according to claim 2, wherein a rear end of said metal housing is connected with a rear cover used for shielding an opening of a rear end of said accepting groove.

13. The connecter according to claim 3, wherein a rear end of said metal housing is connected with a rear cover used for shielding an opening of a rear end of said accepting groove.

14. The connecter according to claim 4, wherein a rear end of said metal housing is connected with a rear cover used for shielding an opening of a rear end of said accepting groove.

15. The connecter according to claim 5, wherein a rear end of said metal housing is connected with a rear cover used for shielding an opening of a rear end of said accepting groove.

16. The connecter according to claim 6, wherein a rear end of said metal housing is connected with a rear cover used for shielding an opening of a rear end of said accepting groove.

17. The connecter according to claim 7, wherein a rear end of said metal housing is connected with a rear cover used for shielding an opening of a rear end of said accepting groove.

* * * * *